US005452512A

United States Patent [19]

Foley et al.

[11] Patent Number: 5,452,512

[45] Date of Patent: Sep. 26, 1995

[54] METHOD OF MAKING AN ELECTRICAL TERMINAL

[75] Inventors: William F. Foley, New Cumberland; Gregory G. Griffith, Carlisle; David H. Gutter, Elizabethtown; William E. McClusky, Harrisburg; Steve Robbins, Greensburg; Bruce W. Shoemaker, Dillsburg, all of Pa.

[73] Assignee: The Whitaker Corporation, Wilmington, Del.

[21] Appl. No.: 316,191

[22] Filed: Sep. 30, 1994

Related U.S. Application Data

[62] Division of Ser. No. 159,903, Nov. 30, 1993, Pat. No. 5,374,204.

[51] Int. Cl.[6] ..... H01R 43/16

[52] U.S. Cl. ..... 29/874; 29/882; 439/78; 439/885

[58] Field of Search ..... 29/882, 874; 439/885, 439/78, 79

[56] References Cited

U.S. PATENT DOCUMENTS

| | | | |
|---|---|---|---|
| 2,755,453 | 7/1956 | Cloutier . | |
| 3,230,493 | 1/1966 | Jensen et al. . | |
| 3,348,191 | 10/1967 | Kinkaid . | |
| 3,400,358 | 9/1968 | Byrnes et al. . | |
| 3,444,504 | 5/1969 | Lynch et al. . | |
| 3,634,819 | 1/1972 | Evans . | |
| 3,731,261 | 5/1973 | Spadoni, Jr. . | |
| 3,862,792 | 1/1975 | Jayne . | |
| 3,997,237 | 12/1976 | White . | |
| 4,066,326 | 1/1978 | Lovendusky . | |
| 4,186,982 | 2/1980 | Cobaugh et al. . | |
| 4,230,384 | 10/1980 | Anhalt . | |
| 4,384,757 | 5/1983 | Andrews, Jr. et al. . | |
| 4,655,518 | 4/1987 | Johnson et al. . | |
| 4,684,203 | 8/1987 | Bihler | 439/751 |
| 4,686,607 | 8/1987 | Johnson . | |
| 4,749,357 | 6/1988 | Foley | 439/80 |
| 4,780,958 | 11/1988 | Shaffer | 29/874 |
| 4,824,380 | 4/1989 | Matthews | 439/78 |
| 4,857,018 | 8/1989 | Pickles | 439/751 |
| 4,869,677 | 9/1989 | Johnson et al. | 439/80 |
| 4,908,942 | 3/1990 | Long et al. | 29/882 |
| 5,004,426 | 4/1991 | Barnett | 439/82 |
| 5,055,055 | 10/1991 | Bakker | 439/78 |
| 5,106,328 | 4/1992 | Prochaska et al. | 439/751 |
| 5,145,383 | 9/1992 | Bowen et al. | 439/885 X |
| 5,240,422 | 8/1993 | Kobayashi et al. | 439/78 |

*Primary Examiner*—Carl J. Arbes
*Attorney, Agent, or Firm*—Anton P. Ness

[57] ABSTRACT

An electrical terminal (10) including a contact section (14) extending from a body section (12), and a pin section (16) extending from the body section to be inserted into a circuit board through hole (20). The pin section (16) is defined by a pair of spaced apart opposing legs (30) each having a compliant portion (42) defined by a pair of arcuate beams (48) spaced apart by a slot (50), the arcuate beam pair at outer edges (54) being larger in dimension than the through hole diameter. Insertion compresses the arcuate beams (48) of each pair together generating force in a first direction, and compresses the legs toward each other generating force in an orthogonal direction.

3 Claims, 2 Drawing Sheets

METHOD OF MAKING AN ELECTRICAL TERMINAL

This application is a Divisional of application Ser. No. 08/159,903 filed Nov. 30, 1993, now U.S. Pat. No. 5,374, 204.

FIELD OF THE INVENTION

The present invention relates to the field of electrical terminals and more particularly to terminals having pin sections for insertion into through holes of circuit boards.

BACKGROUND OF THE INVENTION

In the electrical connector art, various terminals are known which are affixed within passageways of connector housings, each with a contact section exposed at a mating face of the connector for mating with a complementary terminal of a mating connector, and each including an elongate section extending from an opposed mounting face of the housing for insertion into a corresponding through hole of a circuit board when the connector is mounted to a surface of the board. After insertion, such elongate or pin sections are commonly soldered to conductive material plated to the side walls of the through holes or to annular pads surrounding entrances to the through holes, defining electrical connections to respective circuits of the board.

It is known for such pin sections to be configured in such a way as to define compressible spring members along the portions disposed within the through holes upon full insertion, to establish a press fit providing assured mechanical engagement directly against the plating material of the through hole which defines gas tight electrical connections. Such spring members also serve as a retention mechanism holding the connector to the board prior to the soldering operation thus obviating the need for clamps or other tooling.

One such compliant pin section is disclosed in U.S. Pat. No. 3,634,819. Several various embodiments of pin sections all include the common principle of a pair or more of leg sections spaced apart to define a portion having an effective diameter larger than the diameter of the through hole of the circuit board into which the portion is to be inserted. Upon insertion, the spaced apart leg sections are urged toward each other by the walls of the through hole, under compression with sufficient spring strength thereafter for the portion to continuously exert spring bias outwardly against the walls of the through hole after insertion. The leg sections may be formed by flattening originally round stock and then punching an elongate slot into the flattened portion, or by punching an elongate slot into originally flat stock. Another variety is disclosed wherein originally flat stock is stamped to have two or three legs joining upper and lower integral terminal portions and then gently bowing the legs out of the plane of the stock, after which the stamped blank is rolled into a cylindrical shape such that the bowed legs protrude radially outwardly and can be compressed radially inwardly upon through hole insertion. Similar compliant sections are found in U.S. Pat. Nos. 4,655,518; 4,824,380 and 5,106,328.

Another compliant pin section is disclosed in U.S. Pat. No. 3,400,358 in which a pair of outwardly bowed wire halves are welded together at both ends, for insertion of the outwardly bowed portions to be inserted into a common through hole. The facing surfaces of the wires may be flattened at least at the end sections facilitating welding.

It is also known In U.S. Pat. No. 5,004,426 to provide a pair of contacts each of planar construction adjacent each other, having adjacent pin sections for insertion into a common circuit board through hole, and having adjacent tuning fork contact sections at an opposite end for mating to a common complementary contact member, providing redundant circuit paths from the circuit board to the complementary contact. The pin sections include compliant sections each compressible during through hole insertion, said to be internally solder-coated.

In U.S. Pat. No. 4,186,982 a compliant pin section is disclosed to be defined in a solid pin portion initially having a round or square or rectangular cross-section. In one embodiment wherein the pin portion is formed from square stock, the square stock is initially sheared along a limited length axially extending slit to define a pair of leg sections, and the thus-sheared leg sections are formed transversely along the shear plane to be offset with respect to each other in the shear plane. When the offset legs are inserted in an aperture in a circuit board, as the diagonally opposed corners of the offset legs bear against the aperture walls, the offset legs are forced towards each other along the shear plane with facing sheared surfaces experiencing a strong component of force normal to the shear plane, which contributes to a strong spring-like force applied by the legs on the walls of the aperture. The force is strong enough to establish by itself a permanent gas-tight connection to the plating material without subsequent soldering for both self-sufficient mechanical and electrical connection to the board.

In U.S. Pat. Nos. 3,997,237 and 4,066,326 there is disclosed a contact including three legs, or fins, defined along two shear planes, which are pressed against and along each other upon through hole insertion. In U.S. Pat. No. 4,230, 384 a compliant pin terminal is formed from flat stock to have a limited length axial slit defined therealong to form a pair of legs, with the legs then being twisted in opposed directions to define torsion members which become rotated and urged toward each other upon through hole insertion to create an interference fit.

A separate component is assembled to the pin portion of a terminal in U.S. Pat. No. 4,684,203. The component is affixed to the pin and includes a pair of opposed outwardly bowed spring arms of arcuate cross-section coextending along a length of the pin, which upon through hole insertion are urged against the pin portion therebetween and also flattened in cross-section, to generate substantial spring force outwardly against the through hole walls.

And it is also known to provide a contact stamped from flat stock of uniform thickness and formed into a tubular shape to have a compliant pin structure of tubular shape for insertion into a board through hole, in U.S. Pat. No. 4,780, 958, wherein the exposed contact section is to comprise a post extending from the circuit board for wire wrapping.

Certain contacts are provided with receptacle or socket contact sections at ends opposed to the pin sections insertable into the circuit board through holes. Such receptacle contact sections can provide four spring arms arrayed about a post or pin receiving region for engaging the post of the complementary contact member on four sides, and such a structure is made by forming a box-like structure from a blank stamped from a strip of metal which of necessity must have a limited thickness to permit forming. The pin sections must be made of thicker material than that useful in forming the receptacle sections, and commonly the strip of metal is skived into halves of greatly differing thicknesses, with the receptacle half having a thickness of for example about 0.0040 inches and the pin section half having a thickness of for example about 0.025 inches.

It is desired to provide a terminal having a receptacle section formed at one end and a compliant pin section defined at the other for through hole insertion which is fabricatable from a strip of constant thickness metal.

It is further desired to provide such a terminal which provides a controlled reduction in insertion forces and yet establishes sufficient retention force following insertion to obviate any need for solder to define an assured electrical connection with the through hole plating material, thus permitting contact replacement without desoldering and resoldering.

SUMMARY OF THE INVENTION

The present invention comprises a contact terminal having a contact section at one end for mating with a complementary contact section of a mating terminal, such as at a mating interface during connector mating, and a pin section which extends from a mounting face of the connector housing to be inserted into a through hole of a circuit board. The terminal is stamped into a blank from flat stock of uniform thickness to have a body section and to include a pair of legs which coextend from the body section spaced from each other, after which the legs are opposed to each other upon the forming of the terminal from the blank during which the body section is formed into a square shape.

Each of the legs is initially stamped to include a widened portion of limited axial length to have arcuate outer edges, with a shaped slot of limited axial length punched therealong to define beams joined together at ends of the slot and spaced apart at the middle of the slot, which slot may be oval. The pair of legs are initially spaced apart as they extend from the body section of the fully formed terminal with the arcuate beams of each leg disposed in generally parallel planes. The spaced apart arcuate beam pairs define an effective outer diameter at outermost corner edges at the apices of the beam pairs which is larger than the diameter of the through hole into which the terminal will be inserted. Upon insertion into a through hole, the legs are moved toward and against each other, and the arcuate beam pairs are flattened as their outermost corner edges bear against the walls of the through hole, and generate a certain amount of spring strength to create an interference fit within the through hole.

It is an objective of the present invention to provide a terminal which is fabricated from flat thin stock of uniform thickness, having a contact section at one end formed into a socket structure, and at the other end having a pin contact section having a compliant portion for insertion into a circuit board through hole.

It is a further objective to provide such a terminal with a compliant pin contact section defined from thin metal stock and having sufficient spring strength to generate a retention force assuredly defining an electrical connection with the plating material of the through hole without solder.

An embodiment of the present invention will now be described by way of example with reference to the accompanying drawings.

DETAILED DESCRIPTION OF THE PREFERRED EMBODIMENT

Figure 1:
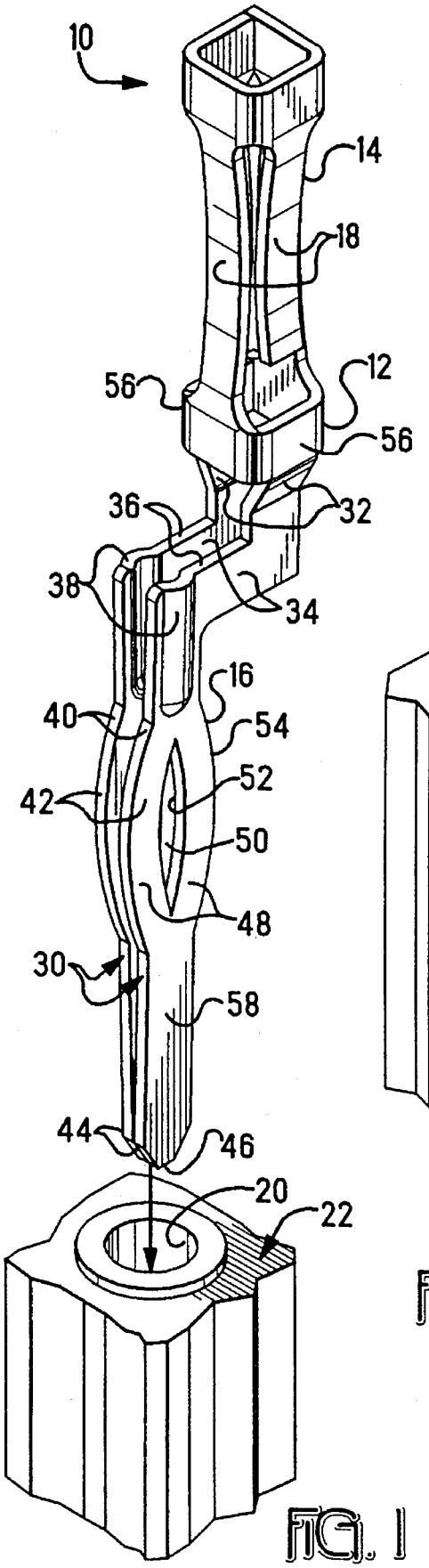
FIG. 1 is an isometric view of the terminal of the present invention showing a pair of coextending spaced legs at one end for insertion into a circuit board through hole, and a socket contact section at the opposed end matable with a male contact receivable thereinto.

Terminal 10 is disclosed in FIG. 1 to have a body section 12, contact section 14 and pin section 16, with body section 12 and contact section 14 to be disposed in a passageway of a dielectric connector housing (not shown) such that contact section 14 is exposed along a mating face to become electrically mated with a complementary contact section of a corresponding terminal of a mating connector (not shown). Contact section 14 is illustrated to comprise a receptacle or socket having a box-shaped cross-section, for mating with a pin member inserted thereinto to engage inner surfaces of four arcuate spring beams 18.

Pin section 16 extends from mounting face of the connector housing to be inserted into an associated through hole 20 of circuit board 22 during mounting of the connector to the board. Pin section 16 is defined by a pair of legs 30 coextending from opposed sides of body section 12 to which they are joined at transition sections 32. Transverse sections 34 provide push surfaces 36 enabling terminal insertion by pressing on the housing (not shown) in which the terminal is disposed and obviating the need for specialized insertion tooling. Preferably leg sections 40 joining ends of transverse sections 34 are strengthened by the forming of axially extending ribs 38 of an arcuate cross-sectional shape convex away from each other. Leg sections 40 include compliant portions 42 therealong and conclude at free ends 44 preferably converging under slight spring bias and facilitating receipt of the pin section end 46 into a respective through hole 20. Free ends 44 are blunted as shown to further facilitate initial entry into through hole 20.

Compliant portion 42 of each leg section 40 includes a pair of gently arcuate beams 48 separated by a slot 50 shown to have an oval shape such that inner and outer edges 52,54 of each arcuate beam 48 are parallel and each beam thus has a constant cross-sectional area. Arcuate beams 48 may have an outer edge 54 defined by a radius of about 0.100 inches while having an inner edge 52 defined by a radius of about 0.088 inches. Arcuate beams 48 may have a length of about 0.041 inches and a widest dimension transversely of about 0.035 inches for insertion into a corresponding through hole having a nominal diameter of about 0.028 inches. Slot 50 may have for example a widest dimension of about 0.011 inches and a length of about 0.053 inches. Transverse sections 34 may be formed to be spaced apart about 0.012 inches, with transition sections 32 about 0.015 inches in length diverging to join opposed sides 56 of body section 12 about 0.018 inches apart. A connector having a plurality of such terminals would have an insertion force in the range of 5 to 15 pounds per terminal enabling connector mounting without special apparatus, with a resultant retention force once within the through hole of at least one pound and up to about 4 pounds per terminal, sufficient to provide mechanical retention of the terminal within the through hole and to establish an electrical connection during long-term in-service use without solder.

Figure 2:
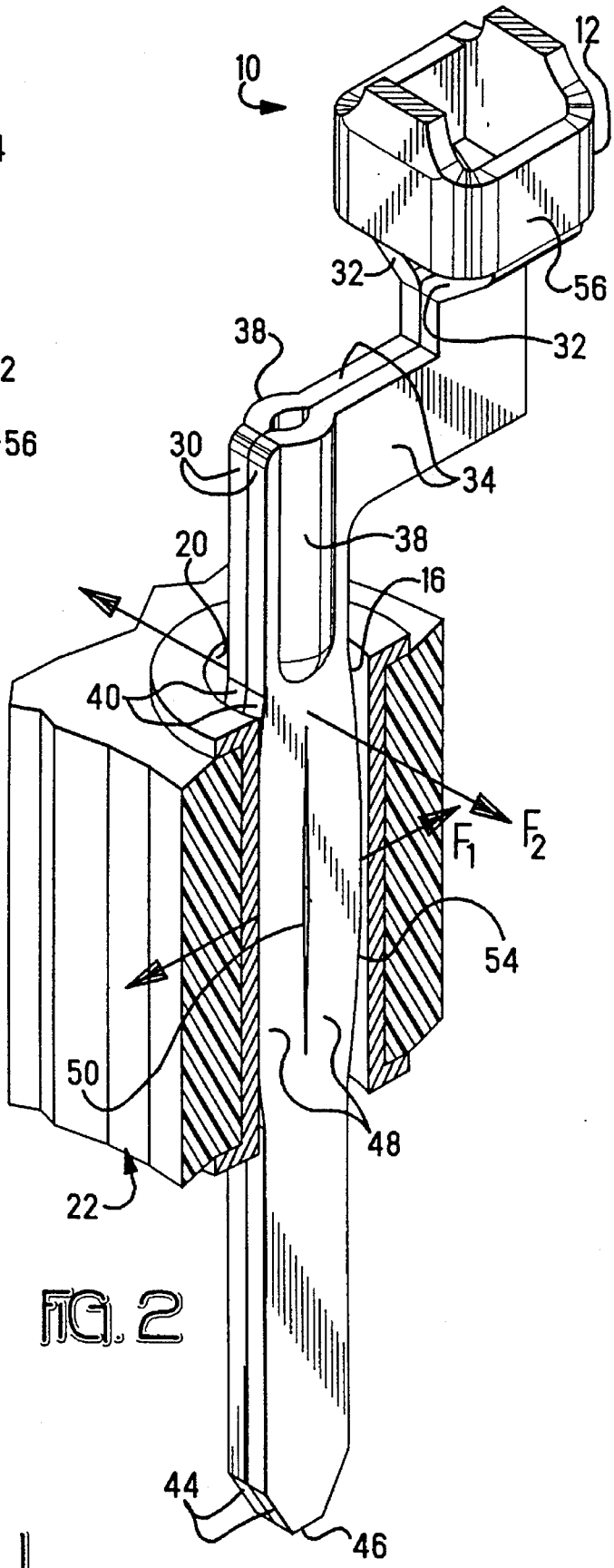
FIG. 2 is an enlarged isometric view of the compliant pin section of the terminal of FIG. 1 after insertion into the through hole.

In FIG. 2 it can be seen that upon insertion into through hole 20, leg sections 40 are urged toward and against each other and arcuate beams 48 of each leg section 40 are compressed toward each other generating outwardly directed spring force $F_1$ along the plane of the pair of arcuate beams 48 of each leg section, as outer edges 54 of arcuate beams 48 engage and bear against the plating material of the side walls of the through hole. Transition sections 32 resist movement of leg sections 40 toward each other, which generates outwardly directed spring force $F_2$ normal to the planes of the leg sections 48.

Figure 3:
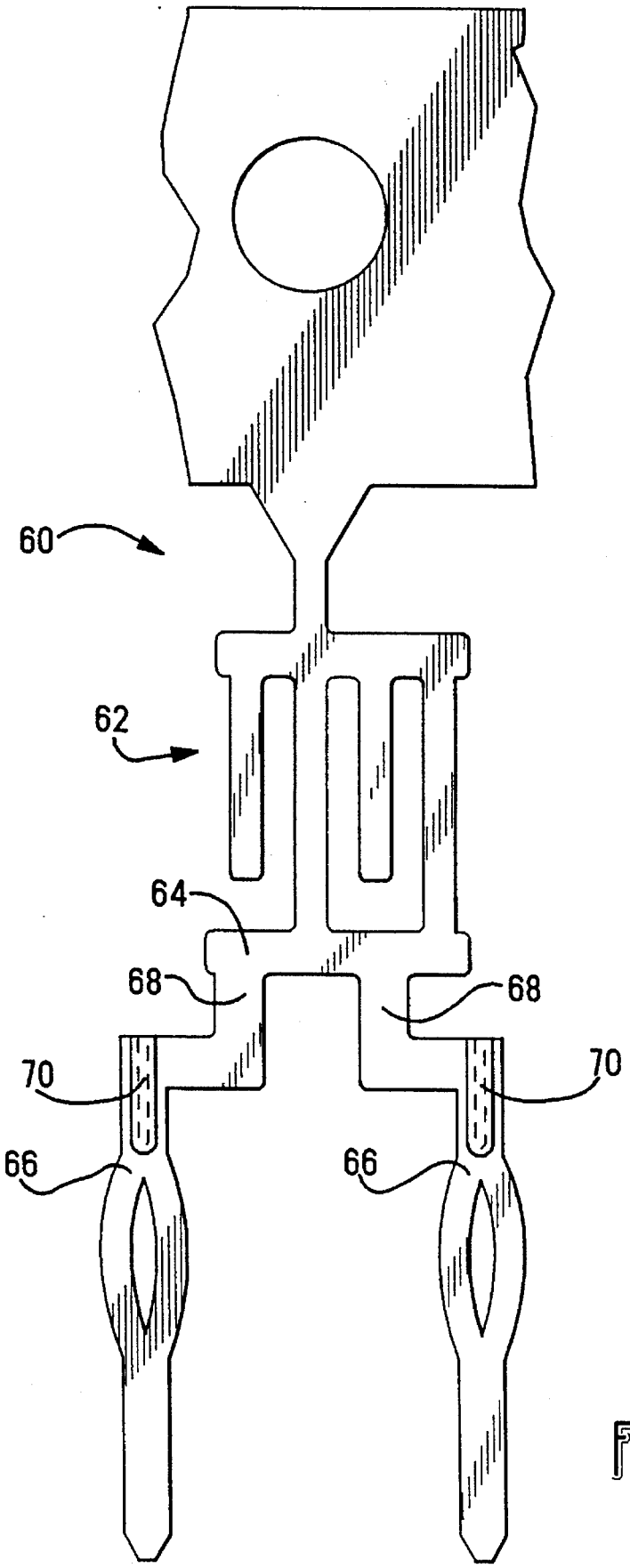
FIG. 3 is a plan view of a blank stamped from flat stock prior to forming of the terminal of FIG. 1.

Referring to FIG. 3, terminal 10 is first stamped into a blank 60 from flat stock of uniform thickness in which all portions of the terminal are disposed in a common plane. Such flat stock may be for example beryllium copper of ¾ hardness, having a stock thickness of about 0.0040 inches, such that the pair of legs when urged together provide an effective thickness of about 0.0080 inches, with nickel underplating and gold plating locally at contact surfaces and gold flash over the remainder. End portion 62 extends in a first direction from transverse central portion 64, and legs 66 extend in a second direction therefrom. Intermediate portions 68 preferably would be formed out of the plane of the blank 60 to be angled therefrom in a direction which will result in transition sections 32 being disposed inwardly toward each other upon complete forming of terminal 10 when side portions 56 will partially enclose an interior region. Embossments 70 preferably would be formed out of the plane of the blank 60 in the opposite direction which will result in strength ribs 38 protruding outwardly from legs 66 upon complete forming of terminal 10.

It is preferable that the outwardly facing major surfaces 58 of leg sections 40 coincide with that major surface of the blank which is struck by the primary die during stamping, so that burrs commonly resulting from stamping would be defined on the corners of the inwardly facing major surfaces and not bear against the plating material along the walls of the through hole 20 during through hole insertion. Optionally burrs may be removed by conventional secondary machining processes prior to conventional plating of the terminal.

Variations and modifications may be provided to the specific embodiment of the invention disclosed herein, which are within the spirit of the invention and the scope of the claims.

What is claimed is:

1. A method of making an electrical terminal suitable for insertion into a through hole of a circuit board and mechanically self-retaining therein in electrical engagement therewith, comprising the steps of:

selecting a sheet of metal of uniform thickness;

stamping a terminal blank therein having a transverse central portion with an end portion extending in a first direction therefrom and a pair of legs coextending from said transverse central portion in said second direction, and each said leg including a pair of arcuate beams separated by a slot and spaced from said free end and defining a distance between outermost edges thereof greater than the diameter of the circuit board through hole into which the terminal is to be inserted; and forming said end portion into a contact section and at least said transverse central portion to define a body section substantially enclosing an interior region partially defined by two spaced apart opposing side portions from which coextend respective ones of said legs to respective free ends defining a pin section insertable into said circuit board through hole such that said compliant portions thereof are spaced apart and oppose each other.

2. The method as set forth in claim 1 further including the step of forming intermediate sections joining said opposing side portions of said body section to respective said legs, said intermediate sections partially converging upon complete forming of the terminal to define transition sections.

3. The method as set forth in claim 1 further including the step of forming strength ribs along portions of said legs proximate said transition sections.

* * * * *